US010287821B2

(12) United States Patent
Marson et al.

(10) Patent No.: US 10,287,821 B2
(45) Date of Patent: May 14, 2019

(54) ROLL-STABILIZED ROTARY STEERABLE SYSTEM

(71) Applicant: Weatherford Technology Holdings, LLC, Houston, TX (US)

(72) Inventors: Daniel A. Marson, Houston, TX (US); Liam A. Lines, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 137 days.

(21) Appl. No.: 15/452,229

(22) Filed: Mar. 7, 2017

(65) Prior Publication Data

US 2018/0258702 A1 Sep. 13, 2018

(51) Int. Cl.

| | |
|---|---|
| ***E21B 7/06*** | (2006.01) |
| ***E21B 44/00*** | (2006.01) |
| ***E21B 47/024*** | (2006.01) |

(52) U.S. Cl.

CPC ..... *E21B 7/067* (2013.01); *E21B 7/062* (2013.01); *E21B 44/005* (2013.01); *E21B 47/024* (2013.01)

(58) Field of Classification Search

CPC . E21B 7/06; E21B 7/067; E21B 7/062; E21B 44/005; E21B 47/024

See application file for complete search history.

(56) References Cited

U.S. PATENT DOCUMENTS

| | | | |
|---|---|---|---|
| 4,416,339 | A | 11/1983 | Baker et al. |
| 5,706,905 | A | 1/1998 | Barr |
| 6,092,610 | A | 7/2000 | Kosmala et al. |
| 6,109,370 | A | 8/2000 | Gray |
| 6,116,354 | A | 9/2000 | Buytaert |
| 6,158,529 | A | 12/2000 | Dorel |

(Continued)

FOREIGN PATENT DOCUMENTS

| | | | |
|---|---|---|---|
| EP | 1008717 | A1 | 6/2000 |
| WO | 2012/012624 | A1 | 1/2012 |

(Continued)

OTHER PUBLICATIONS

PCT Search Report and Written Opinion in counterpart PCT Appl. No. PCT/US2018/019376; dated May 15, 2018; 12 Pages.

(Continued)

*Primary Examiner* — Yong-Suk Ro

(74) *Attorney, Agent, or Firm* — Blank Rome LLP

(57) ABSTRACT

A drilling assembly disposed on a drillstring deviates a borehole (i.e., changes the trajectory of the borehole) advanced by a drill bit. A housing disposed on the drillstring transfers first rotation to the drill bit, and one or more directors are disposed on the housing to rotate therewith. Each of the directors is independently movable between an extended condition and a retracted condition relative to the housing. An actuator is disposed on the assembly and is operable provide a second rotation relative to the first rotation. An internal component is disposed in the housing and is rotatable by the second rotation of the actuator to have first and second conditions relative to each of the one or more directors rotating with the first rotation of the housing. The internal component in the first condition extends a given one of the one or more directors toward the extended condition. Conversely, the internal component in the second condition allows retraction of a given one of the one or more directors toward the retracted condition.

23 Claims, 8 Drawing Sheets

(56) References Cited

U.S. PATENT DOCUMENTS

| | | | |
|---|---|---|---|
| 6,290,003 | B1 | 9/2001 | Russell |
| 6,315,062 | B1 | 11/2001 | Alft et al. |
| 6,470,974 | B1 | 10/2002 | Moore et al. |
| 6,837,315 | B2 | 1/2005 | Pisoni et al. |
| 6,840,336 | B2 | 1/2005 | Schaaf et al. |
| 6,913,095 | B2 | 7/2005 | Krueger |
| 7,004,263 | B2 | 2/2006 | Moriarty et al. |
| 7,360,610 | B2 | 4/2008 | Hall et al. |
| 7,510,027 | B2 | 3/2009 | Weston et al. |
| 7,510,029 | B2 | 3/2009 | Gunsaulis |
| 7,766,098 | B2 | 8/2010 | Farley |
| 8,255,163 | B2 | 8/2012 | Mauldin et al. |
| 8,528,636 | B2 | 9/2013 | Brooks |
| 8,781,746 | B2 | 7/2014 | Schneider et al. |
| 8,827,006 | B2 | 9/2014 | Moriarty |
| 9,347,279 | B2 | 5/2016 | Crowley et al. |
| 9,366,131 | B2 | 6/2016 | Mauldin et al. |
| 9,567,844 | B2 | 2/2017 | Mauldin et al. |
| 10,100,630 | B2 | 10/2018 | Bartel et al. |
| 2004/0016571 | A1 | 1/2004 | Krueger |
| 2004/0222023 | A1 | 11/2004 | Haci et al. |
| 2006/0243487 | A1 | 11/2006 | Turner et al. |
| 2006/0249287 | A1 | 11/2006 | Downton et al. |
| 2009/0222209 | A1 | 9/2009 | Morys |
| 2009/0260884 | A1 | 10/2009 | Santelmann |
| 2010/0163308 | A1 | 7/2010 | Farley et al. |
| 2011/0066392 | A1 | 3/2011 | Judd |
| 2011/0266063 | A1 | 11/2011 | Downtown |
| 2012/0018225 | A1 | 1/2012 | Peter et al. |
| 2012/0160563 | A1 | 6/2012 | Clark et al. |
| 2012/0160565 | A1 | 6/2012 | Downton et al. |
| 2013/0092439 | A1 | 4/2013 | Mauldin et al. |
| 2014/0163888 | A1 | 6/2014 | Bowler et al. |
| 2014/0262507 | A1 | 9/2014 | Marson et al. |
| 2015/0337601 | A1 | 11/2015 | Niina et al. |
| 2016/0002978 | A1 | 1/2016 | Rushton |
| 2016/0090789 | A1 | 3/2016 | Gajji et al. |
| 2018/0252088 | A1 | 9/2018 | Tilley et al. |

FOREIGN PATENT DOCUMENTS

| | | | |
|---|---|---|---|
| WO | 2014/196958 | A1 | 12/2014 |
| WO | 2015/127345 | A2 | 8/2015 |

OTHER PUBLICATIONS

Schlumberger, "PowerDrive X6," Brochure, copyright 2010, 6-pgs.
Weatherford, "Revelotion(R) Rotary-Steerable System," Brochure, copyright 2015, 12-pgs.
Int'l Search Report and Written Opinion in counterpart PCT Appl. PCT/US2017/046883, dated Dec. 5, 2017, 14-pgs.
Int'l Search Report and Written Opinion in PCT Appl. PCT/US2017/046856, dated Nov. 20, 2017, 11-pgs.
First office action in copending U.S. Appl. No. 15/282,242, dated May 3, 2018.
Final office action in copending U.S. Appl. No. 15/282,242, dated Nov. 9, 2018.

ROLL-STABILIZED ROTARY STEERABLE SYSTEM

CROSS-REFERENCE TO RELATED APPLICATIONS

This application is co-pending with U.S. application Ser. No. 15/282,379, filed 30 Sep. 2016 and entitled "Control for Rotary Steerable System" and U.S. application Ser. No. 15/282,242, filed 30 Sep. 2016 and entitled "Rotary Steerable System Having Multiple Independent Actuators," which are both incorporated herein by reference in their entireties.

FIELD OF THE DISCLOSURE

The subject matter of the present disclosure relates to an apparatus and method for controlling a downhole assembly. The subject matter is likely to find its greatest utility in controlling a steering mechanism of a downhole assembly to steer a drill bit in a chosen direction, and most of the following description will relate to steering applications. It will be understood, however, that the disclosed subject matter may be used to control other parts of a downhole assembly.

BACKGROUND OF THE DISCLOSURE

When drilling for oil and gas, it is desirable to maintain maximum control over the drilling operation, even when the drilling operation may be several kilometers below the surface. Steerable drill bits can be used for directional drilling and are often used when drilling complex borehole trajectories that require accurate control of the path of the drill bit during the drilling operation.

Directional drilling is complicated because the steerable drill bit must operate in harsh borehole conditions. The steering mechanism is typically disposed near the drill bit, and the desired real-time directional control of the steering mechanism is remotely controlled from the surface. Regardless of its depth within the borehole, the steering mechanism must maintain the desired path and direction and must also maintain practical drilling speeds. Finally, the steering mechanism must reliably operate under exceptional heat, pressure, and vibration conditions that will typically be encountered during the drilling operation.

Many types of steering mechanism are used in the industry. A common type of steering mechanism has a motor disposed in a housing with a longitudinal axis that is offset or displaced from the axis of the borehole. The motor can be of a variety of types including electric and hydraulic. Hydraulic motors that operate using the circulating drilling fluid are commonly known as a "mud" motors.

The laterally offset motor housing, commonly referred to as a bent housing or "bent sub", provides lateral displacement that can be used to change the trajectory of the borehole. By rotating the drill bit with the motor and simultaneously rotating the motor housing with the drillstring, the orientation of the housing offset continuously changes, and the path of the advancing borehole is maintained substantially parallel to the axis of the drillstring. By only rotating the drill bit with the motor without rotating the drillstring, the path of the borehole is deviated from the axis of the non-rotating drillstring in the direction of the offset on the bent housing.

Another steering mechanism is a rotary steerable tool that allows the drill bit to be moved in any chosen direction. In this way, the direction (and degree) of curvature of the borehole can be determined during the drilling operation, and can be chosen based on the measured drilling conditions at a particular borehole depth.

Although such steering mechanisms are effective, operators are continually looking for faster, more powerful and reliable, and cost effective directional drilling mechanisms and techniques. The subject matter of the present disclosure is directed to such an endeavor.

SUMMARY OF THE DISCLOSURE

According to the present disclosure, a drilling assembly disposed on a drillstring deviates a borehole (i.e., changes the trajectory of the borehole) advanced by a drill bit. The assembly includes a housing, one or more directors, an actuator, and an internal component. The housing is disposed on the drillstring and at least partially rotates with first rotation transferred to the drill bit. The one or more directors are disposed on the housing to rotate therewith. Each of the one or more directors is independently movable between an extended condition and a retracted condition relative to the housing.

The actuator is disposed on the assembly and is operable provide a second rotation relative to the first rotation. The internal component is disposed in the housing and is rotatable by the second rotation of the actuator to have first and second conditions relative to each of the one or more directors rotating with the first rotation of the housing. The internal component in the first condition extends a given one of the one or more directors toward the extended condition. Conversely, the internal component in the second condition allows retraction of a given one of the one or more directors toward the retracted condition.

To deviate the advancing borehole, the assembly changes the trajectory of the drilling assembly as the transverse displacements of the director displaces the longitudinal axis of the housing relative to the advancing borehole.

The directors can be energized or moved hydraulically, mechanically, or both. The hydraulic energization uses fluid to deflect the directors, whereas the mechanical energization uses an eccentric cam to mechanically push out the directors. The actuator can be either mechanical or hydraulic and is a source of contrary rotation to the drillstring in order to orientate the internal component (valve or mandrel). The source of contrary rotation can be provided by an electric motor using a downhole power source, provide by a mud motor coupled with a clutch, or provided by a variable speed transmission driven by the drilling fluid, for example.

According to the present disclosure, a drilling method involves advancing a borehole with a drill bit on a drilling assembly coupled to a drillstring by transferring first rotation of the drilling assembly to the drill bit. A second rotation of an internal component is provided relative to the first rotation by operating an actuator disposed to rotate with the drilling assembly. One or more directors disposed to rotate with the drilling assembly are independently moved using the internal component, and the advancing borehole is deviated with the drilling assembly using the independently moved one or more directors. For example, the internal component can deflect one or more directors at the same time such that at least one of many can be deflected together.

To steer during drilling, a steering direction can be determined for the drilling assembly, and an angular orientation of the drilling assembly can be sensed. The actuation of the drilling assembly can then be varied based upon the determined steering direction and the sensed angular orientation. In this way, the assembly uses geostationary actuation of the individual directors as each rotates with the housing as the housing imparts rotation to the drill bit.

The disclosed system may be directed to a push-the-bit configuration of steering. In push-the-bit, the drilling direction of the bit in a desired direction is changed by pushing the directors against the opposing side of the borehole. Comparable components and techniques disclosed herein can be use in the other type of steering configuration of point-the-bit. In such a point-the-bit configuration, the drilling direction of the bit in a desired direction is changed by pushing an internal drive shaft of the system in an opposite direction. In this way, the driveshaft is pushed in the opposite direction to which the drill bit is to be directed, and an external or internal fulcrum point on the assembly is used to point the bit in the desired direction. As such, the components and techniques disclosed herein with respect to the push-the-bit system can apply equally well to a point-the-bit system because it would merely involve a reversal of pushing components from external (push) to internal (point) and a reversal of the directing of pushing from external to internal.

The foregoing summary is not intended to summarize each potential embodiment or every aspect of the present disclosure.

DETAILED DESCRIPTION OF THE DISCLOSURE

Figure 1:
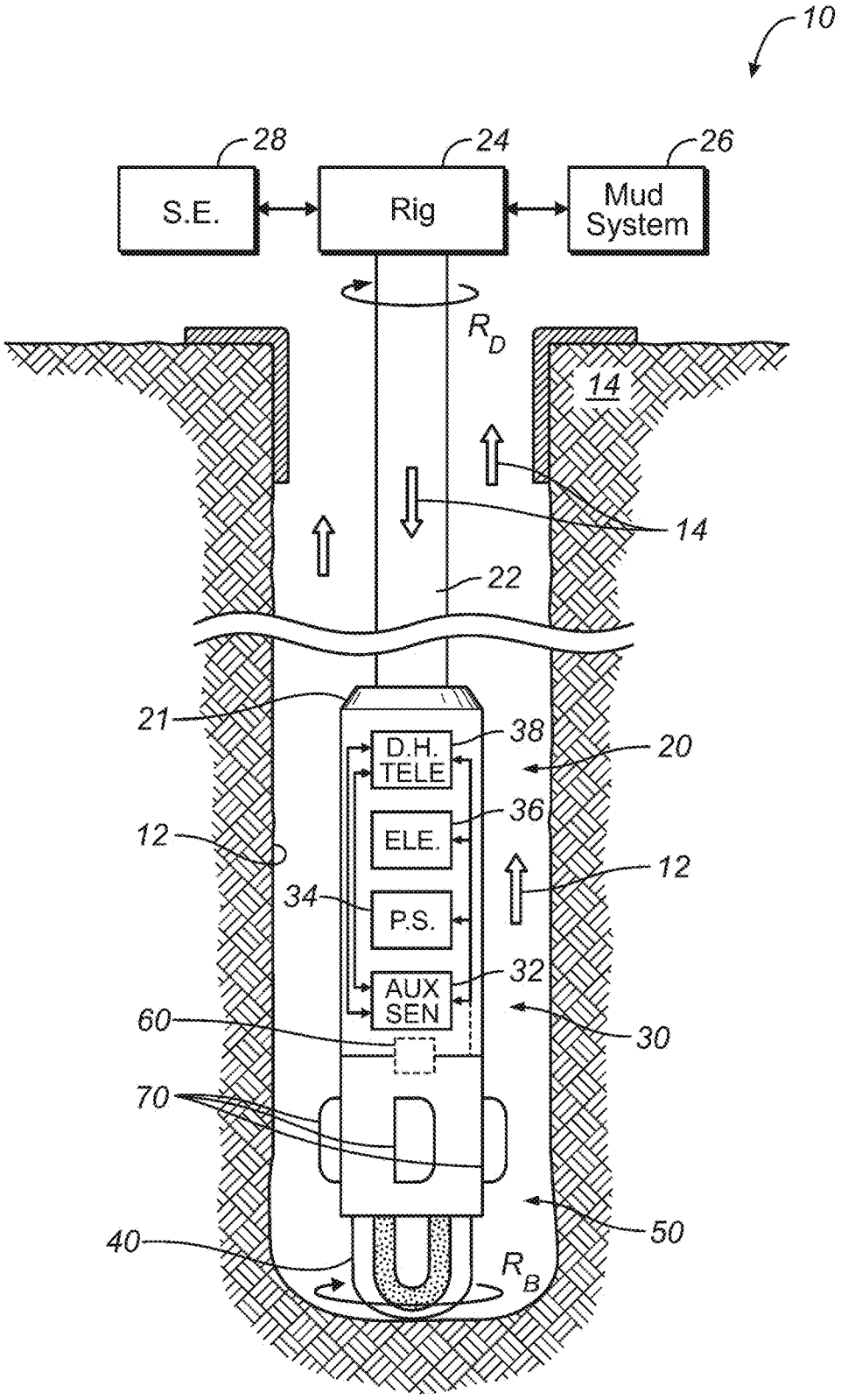
FIG. 1 schematically illustrates a downhole assembly incorporating a roll-stabilized steering apparatus according to the present disclosure.

FIG. 1 schematically illustrates a drilling system 10 incorporating a rotating steering apparatus 50 according to the present disclosure. As shown, a downhole drilling assembly 20 drills a borehole 12 penetrating an earth formation. The assembly 20 is operationally connected to a drillstring 22 using a suitable connector 21. In turn, the drillstring 22 is operationally connected to a rotary drilling rig 24 or other known type of surface drive.

The downhole assembly 20 includes a control assembly 30 having a sensor section 32, a power supply section 34, an electronics section 36, and a downhole telemetry section 38. The sensor section 32 has directional sensors, such as accelerometers, magnetometers, and inclinometers, which can be used to indicate the orientation, movement, and other parameters of the downhole assembly 20 within the borehole 12. This information, in turn, can be used to define the borehole's trajectory for steering purposes. The sensor section 32 can also have any other type of sensors used in Measurement-While-Drilling (MWD) and Logging-While-Drilling (LWD) operations including, but not limited to, sensors responsive to gamma radiation, neutron radiation, and electromagnetic fields, such as available on Weatherford's HEL system.

The electronics section 36 has electronic circuitry to operate and control other elements within the downhole assembly 20. For example, the electronics section 46 has downhole processor(s) (not shown) and downhole memory (not shown). The memory can store directional drilling parameters, measurements made with the sensor section 32, and directional drilling operating systems. The downhole processor(s) can process the measurement data and telemetry data for the various purposes disclosed herein.

Elements within the downhole assembly 20 communicate with surface equipment 28 using the downhole telemetry section 28. Components of this telemetry section 38 receive and transmit data to an uphole telemetry unit (not shown) within the surface equipment 38. Various types of borehole telemetry systems can be used, including mud pulse systems, mud siren systems, electromagnetic systems, angular velocity encoding, and acoustic systems.

The power supply section 34 supplies electrical power necessary to operate the other elements within the assembly 20. For example, the power is typically supplied by batteries, but power can be extracted from the drilling fluid by way of a power turbine, or a combination of both can be used.

During operation, a drill bit 40 is rotated, as conceptually illustrated by the arrow RB. The rotation of the drill bit 40 is imparted by rotation RD of the drillstring 22 at the rotary rig 24. The speed (RPM) of the drillstring rotation RD is typically controlled from the surface using the surface equipment 28. Additional rotation to the drill bit 40 can also be imparted by a drilling motor (not shown) on the drilling assembly 20.

During operation, the drilling fluid system 26 pumps drilling fluid or "mud" from the surface downward and through the drillstring 22 to the downhole assembly 20. The mud exits through the drill bit 40 and returns to the surface via the borehole annulus. Circulation is illustrated conceptually by the arrows 14.

To directionally drill the advancing borehole 12 with hydraulic energization of the devices 70, a controller 60 may be operated to change delivery of a portion of the flow of the fluid (circulated drilling mud) to the rotating steering apparatus 50 having multiple directional devices 70. The apparatus 50 rotates with the drill string 22 in rotating of the drill bit 40. Changing delivery of the fluid is made to each of the multiple directional devices 70 independently and is controlled to alter the direction of the steering apparatus 50 as it advances the borehole 12.

For mechanical energization of the devices 70, the controller 60 may be operated to change physical engagement with the multiple directional devices 70. The apparatus 50 rotates with the drill string 22 in rotating of the drill bit 40. Changing the physical engagement is made to each of the multiple directional devices 70 independently and is controlled to alter the direction of the steering apparatus 50 as it advances the borehole 12. In either case, the controller 60 is controlled using orientation information measured by the sensor section 32 cooperating with control information stored in the downhole memory of the electronics section 36 to direct the trajectory of the advancing borehole 12.

Figure 2:
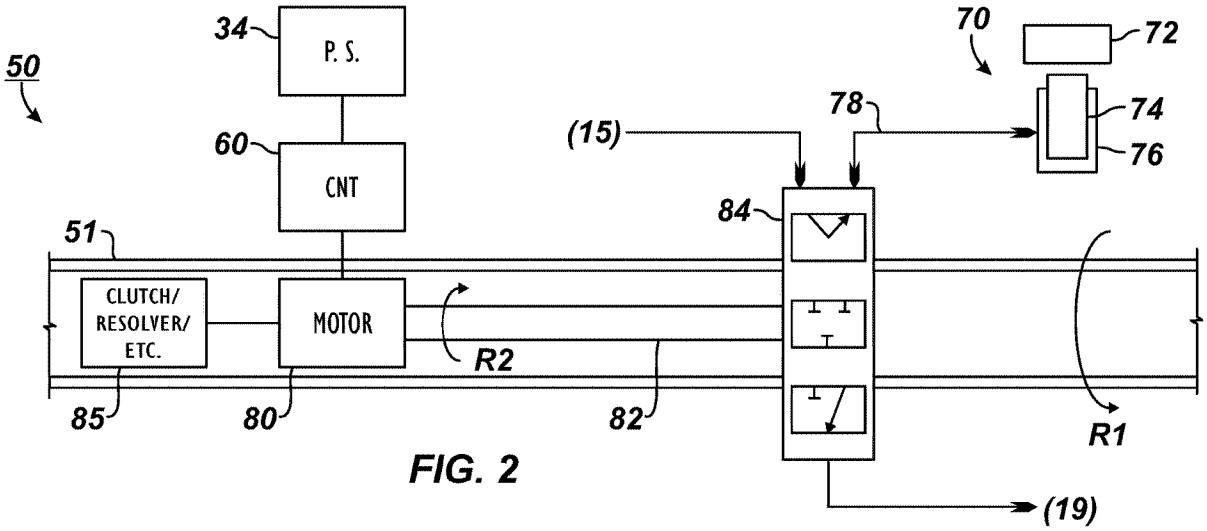
FIG. 2 schematically illustrates a first configuration for a roll-stabilized steering apparatus according to the present disclosure.
Figure 4:
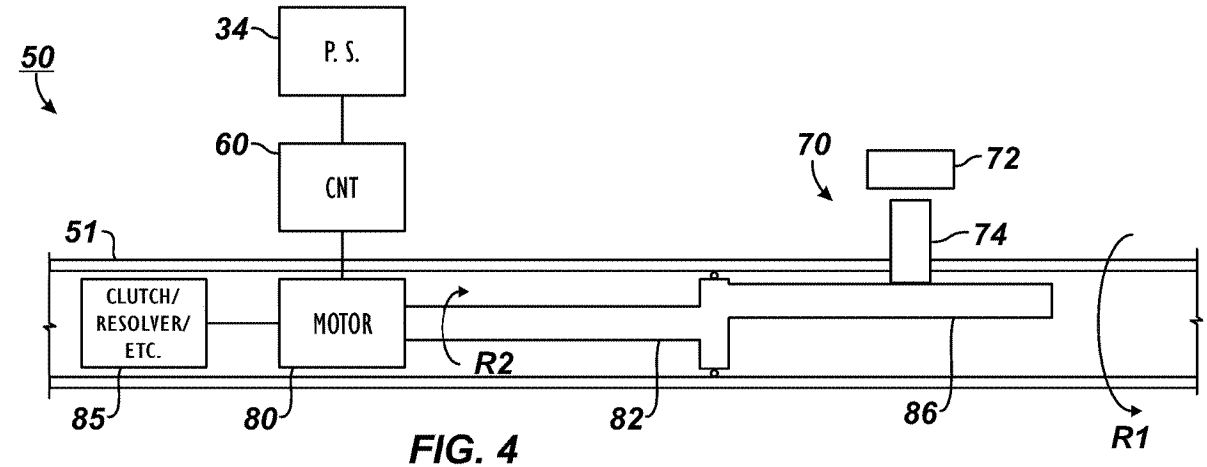
FIG. 4 schematically illustrates a second configuration of a roll-stabilized steering apparatus according to the present disclosure.

By independently operating the multiple directional devices 70, the steering apparatus 50 steers the assembly 20 using active deflection as the apparatus 50 rotates with the drill string 22. Because the entire apparatus 50 rotates, there is a no non-rotating platform in the apparatus 50 to independently actuate the directional devices 70. In one arrangement, a valve (84: FIG. 2) can be an element of the geostationary platform for providing hydraulic energization, but this does not necessarily have to be the case. In another arrangement, for instance, a mandrel (86: FIG. 4) can be an element of the geostationary platform for providing mechanical energization.

During operation, for example, the controller 60 can control the flow of fluid through the downhole assembly 20 and can deliver portions of the fluid independently to the multiple directional devices 70 of the steering apparatus 50 or can control the physical engagement delivered to the devices 70. In turn, the directional devices 70 then use the pressure applied or physical engagement from the delivered flow to periodically extend/retract relative to the drill bit's rotation RB to define the trajectory of the advancing borehole 12.

The independent extension/retraction of the directional devices 70 can be coordinated with the orientation of the drilling assembly 20 in the advancing borehole 12 to control the trajectory of drilling. In the end, the extension/retraction of the directional devices 70 disproportionately engages the drill bit 40 against a certain side in the advancing borehole 12 for directional drilling. (Reference to disproportionate engagement at least means that the engagement in advancing the borehole 14 is periodic, varied, repetitive, selective, modulated, changing over time, etc.)

Moreover, the resultant rotational speed RB of the drill bit 40 can be periodically varied by periodically varying the rotational speed of a mud motor (not shown) and/or by periodically varying the rotational speed RD of the drillstring 22. Such periodic bit speed rotation RB (referred to herein as a "bit speed effect") results in preferential cutting of material from a predetermined arc of the borehole's wall, which in turn results in deviation of the borehole 10. Further details of the bit speed effect are disclosed in incorporated U.S. Pat. No. 7,766,098.

A first configuration of the steering apparatus 50 is schematically shown in FIGS. 2 and 3A-3C, which hydraulically energizes the directors 70. In contrast, a second configuration of the steering apparatus 50 is schematically shown in FIGS. 4 and 5A-5C mechanically energizes the directors 70. Some of the components of the apparatus 50 may be shared between these two configurations.

Looking at the first configuration schematically depicted in FIG. 2, the controller 60 connects to the sensors and power source 34 of the control assembly and connects to each of the directional devices or directors 70—only one of which is schematically shown here. Each directional device 70 includes an actuator or piston 74 and may have a pad member 72 disposed on the apparatus 50 to rotate therewith. Each device 70 is independently operable to move its pad/piston 72/74 between an extended condition and a retracted condition relative to the apparatus 50.

To do this, the controller 60 operates an actuator 80 disposed on the assembly. For this first configuration of the steering apparatus 50 in FIG. 2, the actuator 80 can include a mud pump, a left-handed mud motor, a left-handed turbine, or other type of hydraulic drive operable to provide rotation to a mandrel or shaft 82. With the actuator 80 as a mud motor, the power source 34 can be communicated drilling fluid. Alternatively, the actuator 80 can include an electric motor, a left-handed electric motor, or other type of electric drive operable to provide rotation to a mandrel or shaft 82. With the actuator 80 as an electric motor, the power source 34 can supply electrical power and can include a battery, a turbine generator powered by communicated drilling fluid, or both.

Either way, the actuator 80 (whether hydraulic or electric) is housed in the apparatus' housing 51. In the present example, the housing 51 is a drillstring subcomponent having one end connected toward the drillstring and having an opposing end connected toward the drill bit. The housing 51 as the drillstring subcomponent transfers the rotation from the one end to the drill bit toward the opposite end.

In this sense, the housing 51 rotates with a first rotation R1 imparted by the drillstring (22) and delivered to the drill bit (40). The actuator 80, however, provides a second rotation R2 relative to the first rotation R1. This second rotation R2 can include counter rotation and/or co-rotation so that the mandrel 82 can be "roll-stabilized" relative to the housing 51. In other words, the mandrel 82 can be oriented "stationary," "fixed," "set," etc. relative to the surrounding borehole even as the housing 51 rotates with its first rotation R1. Although the second rotation R2 can be equal and opposite to the first rotation R1, this is not strictly necessary in all implementations. The mandrel 82 can rotate slower or faster than the first rotation R1 and still achieve the purposes disclosed herein of being "roll-stabilized." Moreover, the mandrel 82 can be directed to a desired orientation relative to the borehole for steering the apparatus 50.

The mandrel 82 rotated by the second rotation R of the actuator can thereby have first and second conditions relative to the pads/pistons 72/74 rotating with the first rotation R1 of the housing 51. For instance, the mandrel 82 in the first condition extends a given pad/piston 72/74 toward the extended condition, whereas the mandrel 82 in the second condition retracts the given pad/piston 72/74 toward the retracted condition.

To produce these first and second conditions, the mandrel 82 in FIG. 2 operates a valve 84 disposed in fluid communication between the communicated fluid through the apparatus 50 and the borehole outside the housing 51. The valve 84 is actuated by the second rotation R2 of the actuator 80 as the actuator 80 sets, moves, etc. the mandrel 82 to have the first and second conditions relative to the pads/pistons 72/74 rotating with the first rotation R1 of the housing 51. As such, the valve 84 in the first condition directs the communicated fluid (15) to extend the given pad/piston 72/74 toward the extended condition, while the valve 84 in the second condition vents the communicated fluid (19) to the borehole to retract the given pad/piston 72/74 toward the retracted condition.

As shown, the valve 84 has an inlet in communication with the tool flow (15) that passes through the apparatus 50 from the drillstring (22) to the drill bit (40). The valve 84 also has an outlet in communication outside the housing 51 for vent flow (19). The piston 74 is movable hydraulically in a chamber 76 in fluid communication with the valve 84 via a port 78 so the chamber 76 can receive and vent communicated fluid.

Accordingly, the valve 84 in the first condition directs the communicated fluid (15) to the chamber 76 via the port 78 to extend the given pad/piston 72/74 toward the extended condition. By contrast, the valve 84 in the second condition vents the fluid in the chamber 76 via the port 78 to the borehole through the valve's outlet to retract the given pad/piston 72/74 toward the retracted condition.

Although depicted in FIG. 2 with one actuator 80/82 and valve 84, the system may instead use dual actuators 82 and valves 84 for each piston 74 to achieve respective active energizing and venting. In this case, the dual actuators 80/82 and valves 84 can be tuned with different responses relative to one another for control.

Figure 6A:
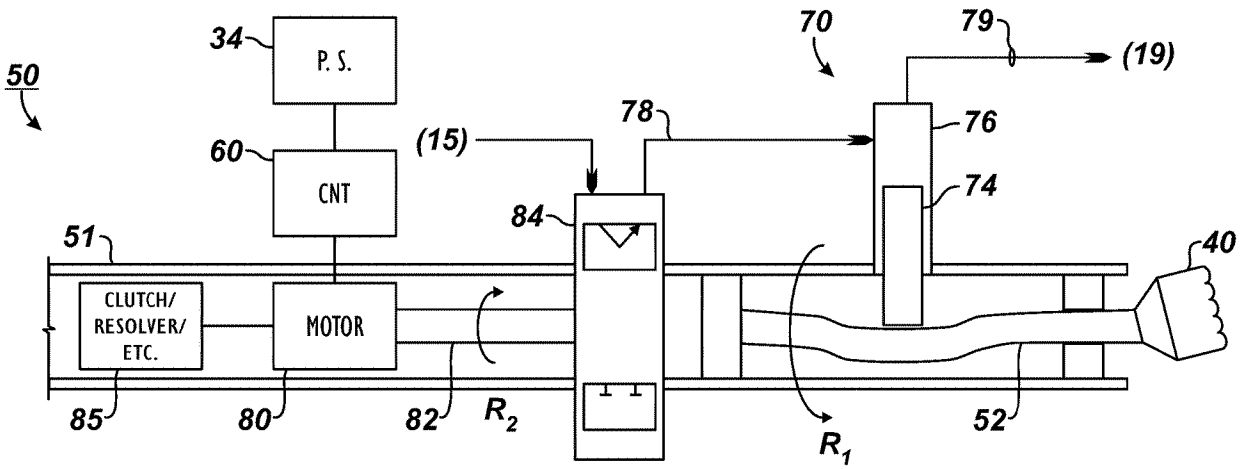
FIG. 6A schematically illustrates the first configuration with alternate arrangements.

Although depicted in FIG. 2 with a valve setting for actively venting the chamber 77 to vent flow 19, the system may instead be always actively or passively venting the piston chamber 76 to vent flow 19 for the borehole. A brief example of this is shown in FIG. 6A. In this case, the valve 84 may have more simplified settings, and the vent flow 19 may passively lead from the piston chamber 76. Moreover, the vent flow 19 leading from the piston chamber 76 to the borehole can be configured or tuned with a choke or a restricted orifice 79 to define a particular flow restriction for the venting.

Spring returns (not shown) or the like for the pistons 74 may be provided to retract the pistons 74 when not energized with piston flow 17. In fact, such spring returns may be necessary is some implementations.

The apparatus 50 operates to steer drilling during continuous rotation, which can be up to 300-rpm or higher. Each actuator piston 74 can be operated to extend its pad 72 at the same target position, synchronous to the drillstring's rotation. Meanwhile, the rotary position of the controller 60 is determined by the sensors of the control system 30 (discussed in more detail later).

Given the above description of this first configuration of the steering apparatus 50, discussion now turns to an embodiment of this first configuration of steering apparatus 50 to achieve directional drilling.

Figure 3B:
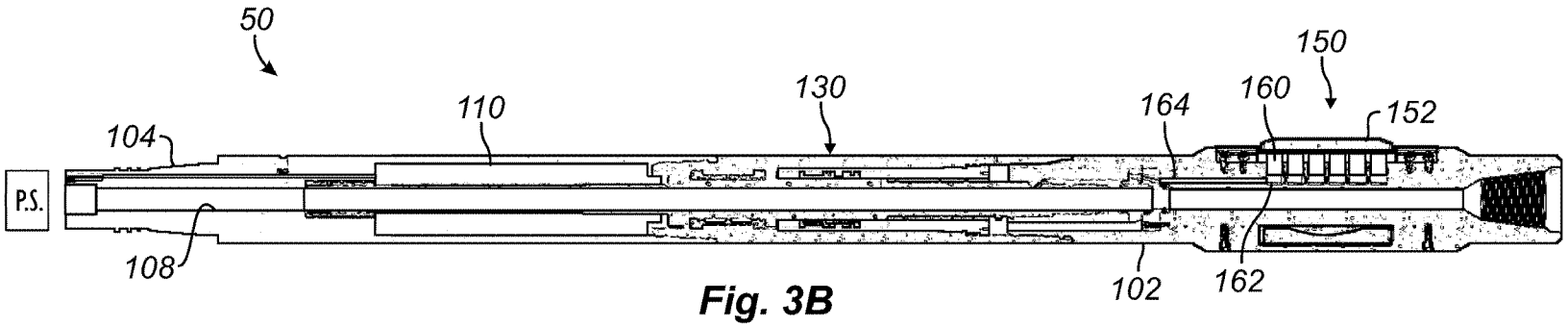
FIGS. 3A-3C illustrate an embodiment of the first configuration of steering apparatus in perspective, cross-sectional, and end-sectional views.
Figure 3A:
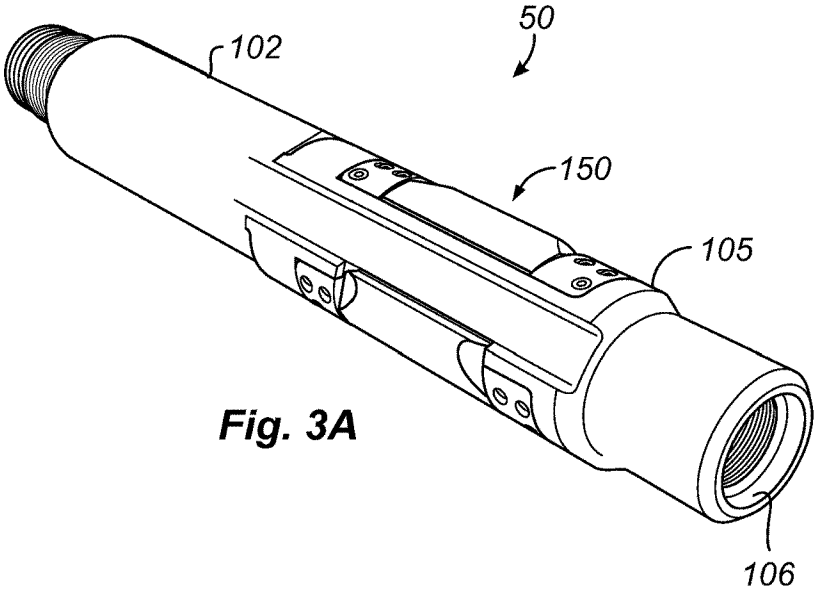

FIG. 3A illustrates a perspective view of portion of a steering apparatus 50 for the drilling assembly (20) according to the present disclosure. As already noted, the steering apparatus 50 of the drilling assembly (20) is disposed on a drillstring (22) for deviating a borehole advanced by the drill bit (40). Further details of the steering apparatus 50 are provided in the cross-sectional view of FIG. 3B and the end-sectional view of FIG. 3C.

The apparatus 50 has a housing or drill collar 102 that couples at an uphole end 104 to uphole components of the assembly (20) and that couples at a downhole end 106 to downhole components of the assembly (20). Multiple directional devices 150 are disposed on the housing 102 near the end (106) for connection toward the drill bit (40), and each of the devices 150 is associated with an actuator device 110 also disposed on the housing 102. The directional devices 150 can be arranged on multiple sides of the housing 102 (either symmetrically or asymmetrically), and they can be disposed at stabilizer ribs or other features 105 on the housing 102.

Figure 3C:
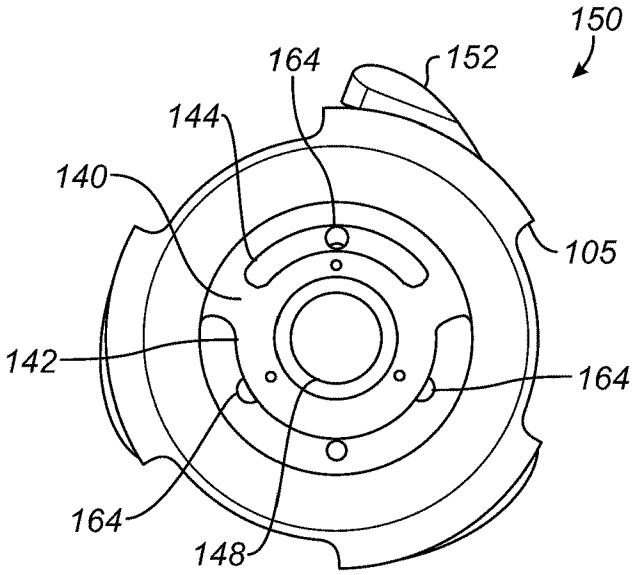

As shown here in FIGS. 3A-3C, the steering apparatus 50 includes three directional devices 150 arranged at about every 120-degrees. In general, more or less devices 150 can be used. Preferably, the arrangement is symmetrical or uniform, which simplifies control and operation of the apparatus 50, but this is not strictly necessary.

Each of the directional devices 150 includes a pad 152 that rotates on a pivot point. For each device 150, one or more pistons 160 engage the pad 152 to pivot the pad 152 outward from the housing 102. A biasing element (not shown) can bias the pad 152 and/or pistons 160 toward retraction. In this way, the piston 160 is alternatingly displaceable in the housing chamber 162 between extended and retracted conditions to pivot the pad 152 to extend away from the housing 102 or retract in toward the housing 102.

The apparatus of FIGS. 3A-3C hydraulically actuates the directional devices 150 in a similar to that discussed above with reference to FIG. 2. The housing 102 has an axial bore 108 along the housing's longitudinal axis (L) communicating the drillstring (22) with the drill bit (40). Internal flow components can direct at least a portion of the tool flow (15) from the bore 108 independently to each of the piston chambers 162 for the pistons 160 and can vent the fluid from in the piston chambers 162 independently to outside the apparatus 50 (i.e., to the borehole annulus).

The pads 152 can have surface treatment, such as Tungsten Carbide hard facing, or other feature to resist wear. The housing 102 can be configured for more than one borehole size. For example, the housing 102 can be used for drilling 8⅜, 8½, and 8¾ in. hole sizes. However, different pads 152 of different lengths and dimensions can be used with a given the housing 102 for the different hole sizes. This gives some versatility and modularity to the assembly.

The internal flow components include a mandrel or shaft 120 disposed in the housing bore 108. The mandrel 120 has an internal bore 128 for communicating the bore flow (15) from the drillstring (22) through the apparatus 50 and to the drill bit (40).

An electric motor 110 disposed in the housing 102 is powered and controlled by the power source 34 and controller 50 via a connection. Operation of the motor 110 rotates the mandrel 120 with a second rotation R2 relative to the first rotation R1 of the housing 102 in a manner described previously. A bearing assembly 130 supports the mandrel 120 in the housing 102.

To determine a given start position, the system can use a resolver or a gear box, can have a resolver on a motor as the actuator, can have hall effect sensor, or can use sensing of pressure spikes. For example, position of the motor 110 can be determined for control purposes using a resolver or the like. However, various forms of sensing could be used. For example, a Hall Effect sensor associated with the motor 110 can monitor the shaft's position to determine a given start position or the like. Moreover, pressure spikes from the open/closing of the valve can be used to figure out a given start position of the motor 110.

In one embodiment, continuous housing rotation can reach up to 300-rpm. Meanwhile, the brushless motor 110 may rotate counter to the housing's rotation—equal and opposite to the drillstring with sufficient torque to overcome any seal, bearing and valve drag.

Toward its end, the mandrel 120 includes a valve 140, which can have first and second conditions to deliver or vent fluid to each of the directional devices 150 via ports 164. In particular, the valve 140 has a flow inlet 144 for delivering the communicated fluid. The flow inlet 144 communicates with the bore flow (15) in the mandrel's bore 128. At least a portion of the communicated fluid can enter the flow inlet 144 and can be directed to the passage 164 for a given one of the directional devices 150 when the valve 140 is in the first condition relative thereto. Accordingly, the bore flow (15) passing into the flow inlet 144 can communicate via the aligned or exposed port 164 to the piston chambers 162 of the pistons 160 so that the pad 152 can be extended outward from the housing 102 to engage the surrounding borehole.

At the same time, the valve has a flow outlet 142 in communication outside the housing 102 for venting the communicated fluid. The flow outlet 142 communicates outside the housing 102. The fluid from the directional devices 150 can pass into the flow outlet 142 when the valve 140 is in the second condition relative thereto. Accordingly, the fluid in the piston chambers 162 of the devices 152 can vent via the aligned or exposed port 164 to the valve's outlet 152 so that the pistons 160 and pads 152 can be retracted inward from the housing 102 to disengage engage the surrounding borehole.

As best shown in FIG. 3C, the flow inlet 144 can define an arced slot so that the inlet 144 in the first condition of delivering bore flow can be aligned for an expanse of the housing's rotation R1 to the respective device's port 164. Similarly, the flow outlet 142 can also define an arced slot so that the outlet 142 in the second condition of venting fluid can be aligned for an expanse of the housing's rotation R1 to the other respective devices' ports 164. The expanses may be defined such that one of the ports 164 aligns at one time with the inlet 144 while two of the other ports aligns with the outlet 142. Other configurations are possible where there is some overlap in the respective alignment. There may also be intermediate states where alignment does not occur such that the fluid communication between the ports 164 with the inlet 144 and/outlet 142 is closed.

Delivery and vent dwell times are set mechanically by the windows (i.e., flow inlet 142 and outlet 144) of the distribution valve 140 of the mandrel 120. Position measurements of the housing 102 using the control system 200. The brushless motor 110 is mechanically fixed to the housing 102. Hall Effect sensors within the brushless motor's encoder package can provide the relationship between the motor housing and the motor output shaft. Other arrangements can be used as disclosed herein. For example, a clutch can couple to a mud motor and a bearing package, and the components can keep the internal mandrel 120 as essentially non-rotating relative to the target magnetic or gravity direction.

Turning now to FIG. 4, the second configuration of the steering apparatus 50 is schematically illustrated. Again, the controller 60 connects to the sensors and power source 34 of the control assembly and connects to each of the directional devices 70—only one of which is schematically shown here. Each directional device 70 includes a piston 74 and may have a pad member 72 disposed on the apparatus 50 to rotate therewith. As before, each device 70 is independently operable to move its pad/piston 72/74 between an extended condition and a retracted condition relative to the apparatus 50.

To do this, the controller 60 operates an actuator 80 disposed on the assembly 50. Again, the actuator 80 can be an electric motor, a mud pump, or other type of drive operable to provide rotation to a mandrel or shaft 82. The actuator 80 is housed in the apparatus' housing 51, which rotates with a first rotation R1 imparted by the drillstring (22) and delivered to the drill bit (40). The actuator 80, however, provides a second rotation R2 relative to the first rotation R1 in a similar manner discussed above.

The mandrel 82 rotated by the second rotation R of the actuator 80 can thereby have first and second conditions relative to the pads/pistons 72/74 rotating with the first rotation R1 of the housing 51. For instance, the mandrel 82 in the first condition extends a given pad/piston 72/74 toward the extended condition, whereas the mandrel 82 in the second condition retracts the given pad/piston 72/74 toward the retracted condition.

To have these conditions, the mandrel 82 in FIG. 4 manipulates an eccentricity or cam 86 in the apparatus 50 relative to the pads/pistons 72/74. The eccentricity 86 is oriented by the second rotation R2 of the actuator 80 as the actuator 80 sets, moves, etc. the mandrel 82 to have the first and second conditions relative to the pads/pistons 72/74 rotating with the first rotation R1 of the housing 51. As such, the eccentricity 86 in the first condition mechanically engages the given pad/piston 72/74 to extend it toward the extended condition, while the eccentricity 86 in the second condition mechanically disengages from the given pad/piston 72/74 to allow it to retract toward the retracted condition.

Given the above description of this second configuration of the steering apparatus 50, discussion now turns to an embodiment of this second configuration of steering apparatus 50 to achieve directional drilling.

Figure 5A:
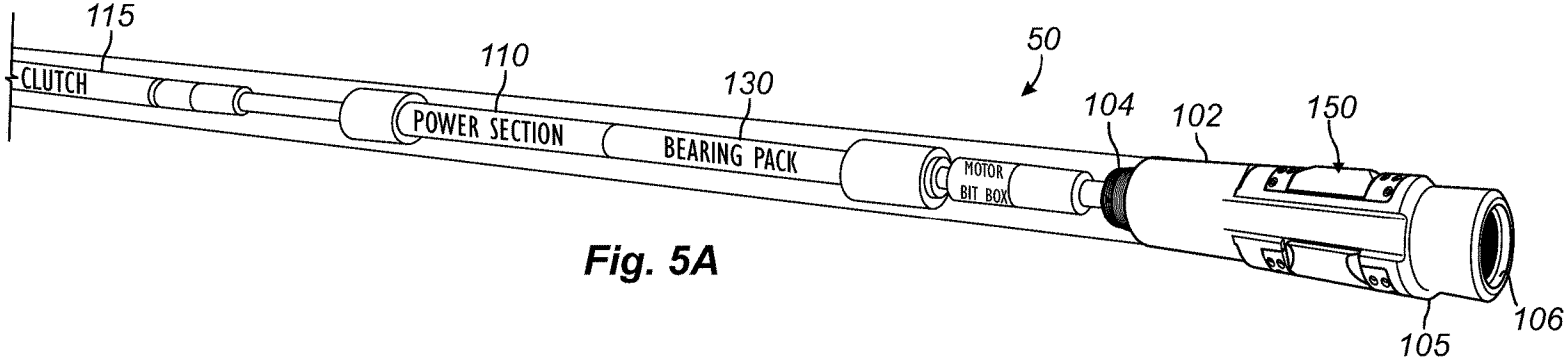
FIGS. 5A-5C illustrate an embodiment of the second configuration of steering apparatus in perspective, cross-sectional, and end views.
Figure 5B:
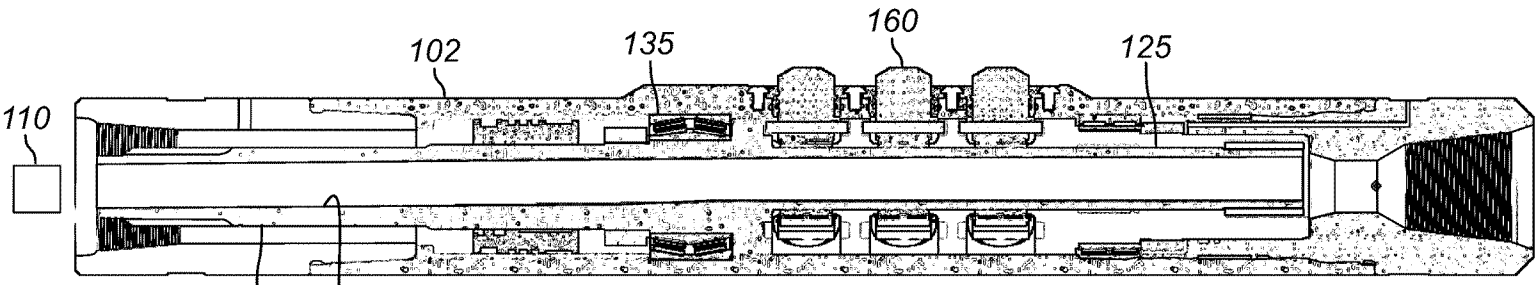
Figure 5C:
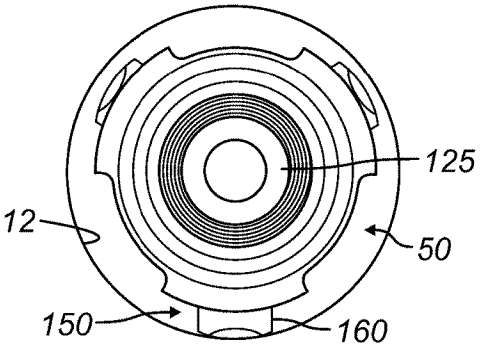

FIGS. 5A-5C illustrate this second configuration of FIG. 4 for the steering apparatus 50. As before, FIG. 5A illustrates a perspective view of portion of the steering apparatus 50 for the drilling assembly (20). As already noted, the steering apparatus 50 of the drilling assembly (20) is disposed on a drillstring (22) for deviating a borehole advanced by the drill bit (40). Further details of the steering apparatus 50 are provided in the cross-sectional view of FIG. 5B and the end view of FIG. 5C.

In this arrangement, each of the directional devices 150 includes one or more pistons 160 that can be mechanically extended and retracted from the housing 102. A pivoting pad 152 can be provided for each device 150 and can be pivoted by the pistons 160 in a manner similar to that discussed previously.

As will be appreciated with the configurations in FIGS. 3C and 5C show, different arrangements of pads, pistons, and biasing elements can be used to extend and retract relative to the apparatus' housing 102. In fact, pistons 160 alone can be used on the apparatus 50 to extend and retract for engaging or disengaging a borehole without the use of pivoting pads 152, as explicitly shown here.

In this arrangement of FIGS. 5A-5C, internal components can mechanically operate the directional devices 150 in a manner similar to that discussed above with reference to FIG. 4. The internal components include a mandrel or shaft 120 disposed in the housing bore 108. The mandrel 120 has an internal bore 128 for communicating the bore flow (15) from the drillstring (22) through the apparatus 50 and to the drill bit (40).

An electric motor 110 disposed in the housing 102 is powered and controlled by the power source 34 and controller 50. Operation of the motor 110 rotates the mandrel 120 with a second rotation R2 relative to the first rotation R1 of the housing 102 in a manner described previously. A bearing assembly 130 supports the mandrel 120 in the housing 102.

Toward its end, the mandrel 120 includes an eccentricity or cam 125, which in this example is an off-axis end or extension of the mandrel 120. Depending on its orientation, the eccentricity 125 can have first and second conditions relative to each of the directional devices 150. In particular, the eccentricity 125 in the first condition relative to one of the direction device 150 can be oriented closer to the pistons 160 so that the eccentricity 125 pushes the pistons 160 outward from the housing 102. At the same time, the eccentricity 125 in the second condition relative to the other direction devices 150 can be oriented away from the pistons 160 so that the eccentricity 125 allows the pistons 160 to return into the housing 102 to disengage engage the surrounding borehole.

The eccentricity 125 can be offset so that one of the devices 150 is extended at one time while two of the other devices 150 are retracted. Other configurations are possible where there is some overlap in the respective engagement. There may also be intermediate states where engagement does not occur such that none of the devices 150 is pushed toward extension.

So far, the disclosed system in FIGS. 2, 4, etc. has been directed to a push-the-bit configuration of steering. In push-the-bit, the drilling direction of the bit in a desired direction is changed by pushing against the side of the borehole in an opposing direction. Comparable components and techniques disclosed herein can instead be used in the other type of steering configuration of point-the-bit.

FIG. 6A provides a brief example of this. The piston 74 disposed in the piston chambers 76 of the system's housing 51 is directed inward against an internal shaft 52 connected to the drill bit 40. The piston 74 is movable against the shaft 52 to change the pointing of the bit 40. (Although depicted for the hydraulic configuration, the same teachings can be applied to the mechanical configuration as disclosed here.) The internal shaft 52 can be a flexible shaft as shown, although a jointed shaft or the like can be used so that pushing against the shaft 52 in one direction can either move the drill bit 40 in the same direction or an opposite direction.

In previous arrangements, the housing 51 included a drillstring subcomponent having one end connected toward the drillstring and having an opposing end connected toward the drill bit. Therefore, the housing 51 as the drillstring subcomponent transferred the rotation from the drillstring to the drill bit, and the elements of the apparatus 50 rotated with the transferred rotation. Other configurations are possible.

Figure 6B:
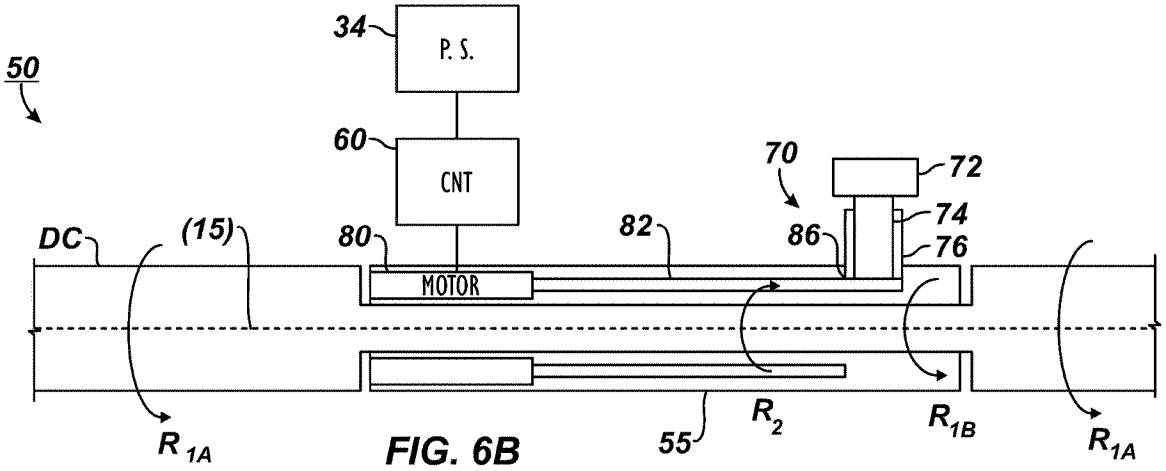
FIG. 6B schematically illustrates an alternative configuration of a roll-stabilized steering apparatus according to the present disclosure.

For example, FIG. 6B schematically illustrates an alternative configuration of a roll-stabilized steering apparatus 50 according to the present disclosure. Many components of this apparatus 50 are similar to previous embodiments (e.g., FIG. 4) so like reference numbers are used. Here, the apparatus 50 includes a housing 55 in the form of a sleeve or collar rotatably disposed on a drillstring subcomponent DC. Various forms of bearing and sealing assemblies can be used. The drillstring subcomponent DC transfers the rotation R1A from the drillstring at one end to the drill bit at the opposite end.

The sleeve 55, however, may be capable of rotating with its own rotation R1B relative to the drillstring component's rotation R1A. For example, the sleeve 55 can passively rotate, and the sleeve 55 and the elements of the apparatus 50 can rotate at a slower speed in the borehole than the drillstring's rotation R1A. In fact, the sleeve 55 may be "non-rotating" in the borehole. Either way, the reduced rotating speed of the sleeve 55 can increase directional response over the apparatus 50. For its part, the motor 80 or other drive for the stem 82 can provide the second rotation R2 for the purposes of actuating the directors 70 carried on the sleeve 55.

Figure 7:
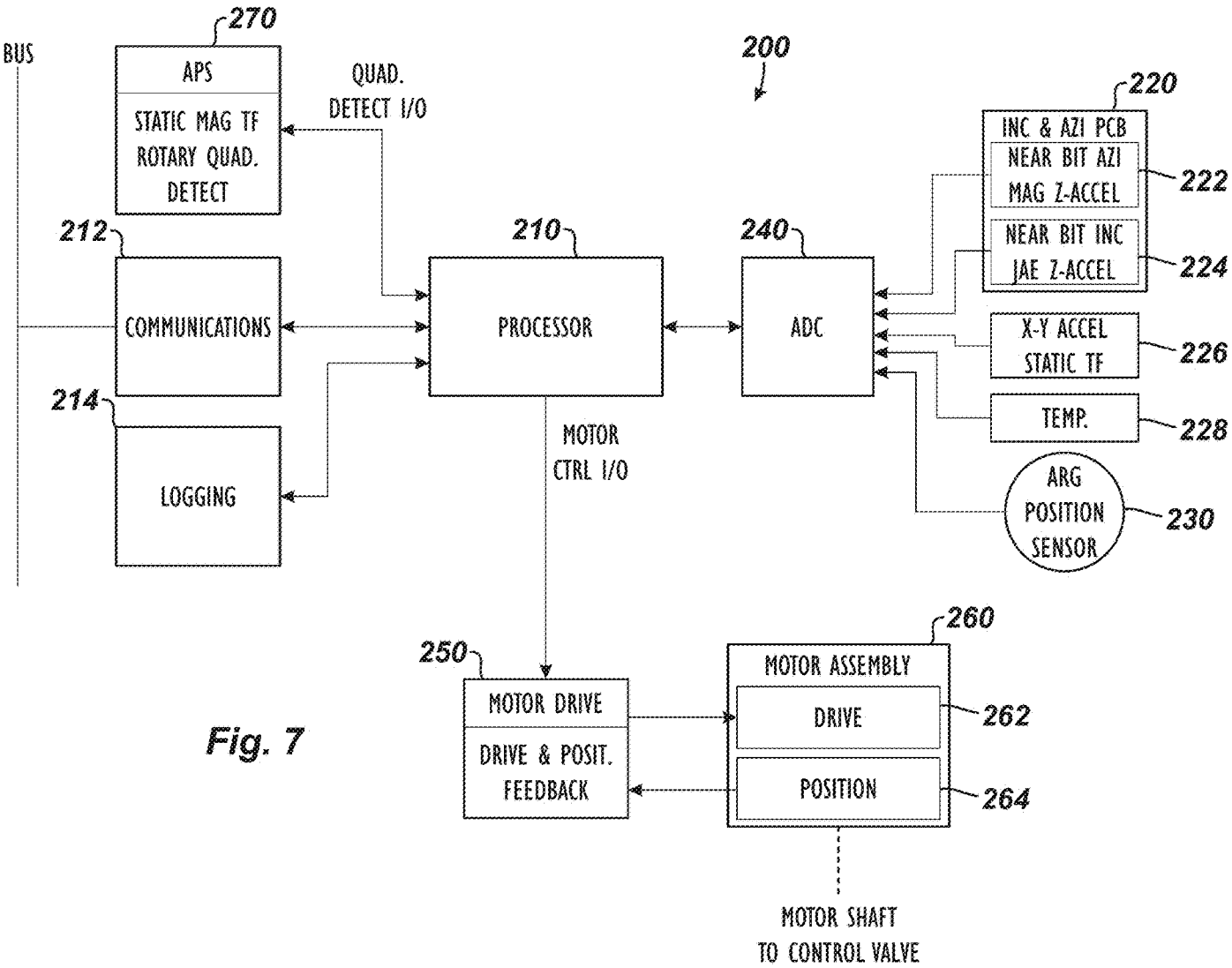
FIG. 7 illustrates a schematic of a control system for the disclosed steering apparatus.

FIG. 7 illustrates a schematic of a control system 200 for the steering apparatus 50 of the present disclosure. Further details are disclosed in incorporated U.S. application Ser. No. 15/282,379, entitled "Control for Rotary Steerable System.") The control system 200 as depicted here can combine or can be part of one or more previously disclosed elements, such as control assembly 30, controller 60, etc., which are consolidated in the description here. Separate reference to some of the components may have been made for the sake of simplicity.

The control system 200 includes a processing unit 210 having processor(s), memory, etc. Sensor elements 220 to 230 interface with the processing unit 210 and may use one or more analog-to-digital converters 240 to do so. In general, the control system uses an angular rate gyroscope to determine an angular rate of the apparatus 50, and readings from a magnetometer give a highside of the apparatus 50 for orientation of the apparatus 50 relative to the borehole.

For example, various sensor elements can include inclinometers, magnetometers, accelerometers, and other sensors that provide position information to the processing unit 210. In particular, an inclinometer and azimuthal sensor element 220 can include a near-bit azimuthal sensor 220 and a near-bit inclinometer sensor 224, which may use magnetometers and Z-axis accelerometers. A static toolface sensor 226 can provide the toolface of the apparatus (50) and can have X and Y axes accelerometers. A temperature sensor 228 can provide temperature readings. Finally, an angular rate gyroscope (ARG) sensor 230 can provide the angular rate of the apparatus (50) during operation for obtaining position readings.

The processing unit 210 also communicates with an angular position sensor (APS) element 270, which provides static magnetic toolface and detects the rotary quadrant of the apparatus (50) during operation. The processing unit 210 can communicate with other components of the apparatus (50) via communication circuitry 212 and a bus and can store information in logging memory 214.

Finally, the processing unit 210 provides controls to a motor drive 250 used for the motor assembly 260. The motor drive 250 may monitor drive and position feedback from the motor assembly 260. Each of the pad actuators 260 includes a module 262 for operating the actuator 262. For its part, the motor assembly 260 includes a drive module 262 and a position module 264 to rotate the motor shaft (i.e., the internal mandrel 120) and control the valve (140) or the eccentricity (125) depending on the components of the steering mechanism.

The control system 200 operates based on discrete position information obtained with the various sensor elements 222, 224, 226, 230, 270, etc. For example, the resolution of the position information can be 0.5 ms @ 300 rpm, which would give a angular resolution of about 0.9° for the apparatus' rotation. Additionally, the angular rate gyroscope sensor 230 is used in conjunction with X-Y crossovers from the APS element 270 to obtain position information at about 3-kHz. The X-Y accelerometers obtain an offset value of static gravity to magnetic highside for determining toolface of the apparatus (50).

The processing unit 210 processes the input of the various readings and the monitoring of the motor assembly 230 and provide motor control signals to the motor drive 250. Overall, the control system 200 includes an inner control loop for holding the internal mandrel 120 geostationary.

Figure 8B:
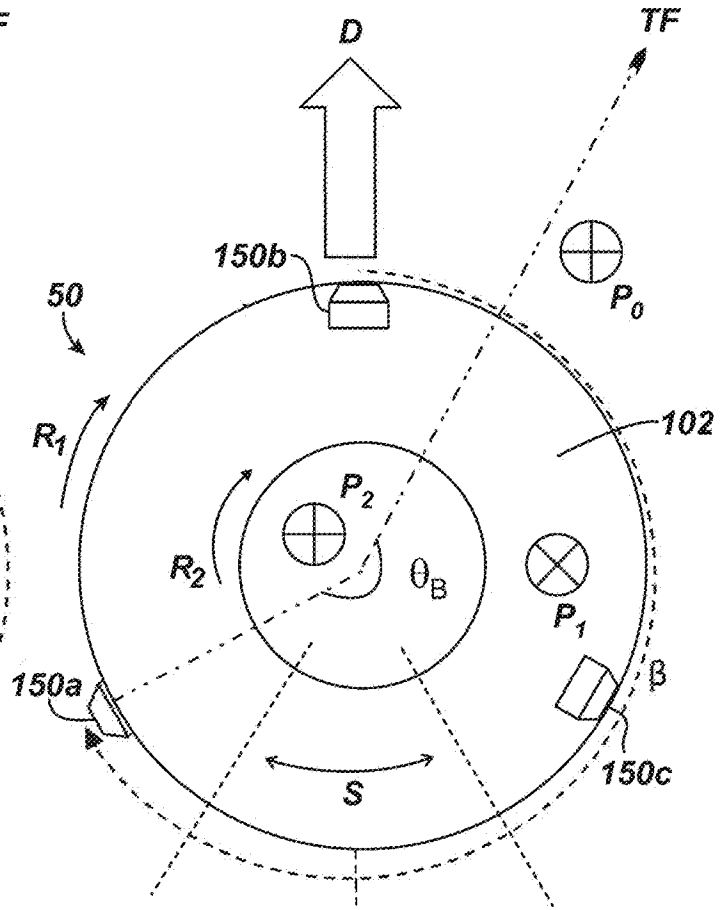
FIGS. 8A-8B schematically illustrate end views of the steering apparatus during operation.
Figure 8A:
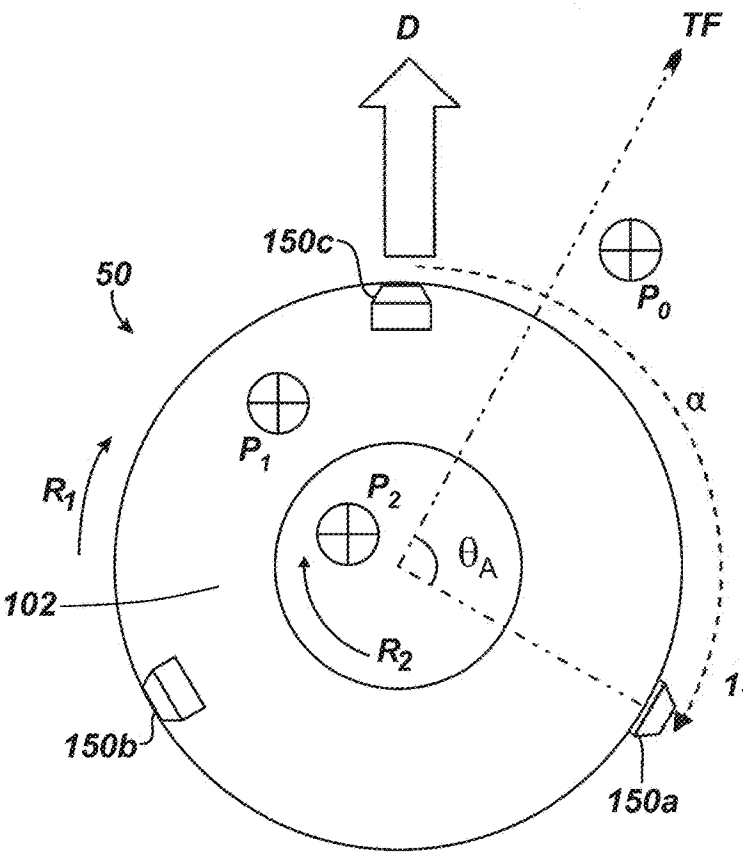

Having an understanding of the steering apparatus 50 and the control system 200, discussion now turns to operation of the drilling assembly 20. FIGS. 8A-8B illustrate schematic end views of the steering apparatus 50 in two states of operation. As noted herein, the steering apparatus 100 has multiple directional devices 70 disposed around the housing 102, such as three directional devices 150*a-c* depicted here.

As expressed herein, the directional devices 150*a-c* rotate with the housing 102, and the housing 102 rotates with the drillstring. As the drill bit rotates with the housing 102 and the drillstring, the transverse displacement of the directional devices 150*a-c* can then displace the longitudinal axis of the housing 102 relative to the advancing borehole. This, in turn, tends to change the trajectory of the advancing borehole. To do this, the independent extensions/retractions of the directional devices 150*a-c* is timed relative to a desired direction D to deviate the apparatus 50 during drilling. In this way, the apparatus 50 operates to push the bit (40) to change the drilling trajectory.

FIGS. 8A-8B show one of the movable directional devices 150*a-c* extended therefrom during a first rotary orientation (FIG. 8A) and then during a later rotary orientation (FIG. 8B) after the housing 102 has rotated. Because the steering apparatus 50 is rotated along with the drillstring (22), the operation of the steering apparatus 50 is cyclical to substantially match the period of rotation of the drillstring (22).

For illustrative purposes, a reference point PB for the surrounding borehole is depicted relative to a reference point PH on the housing 102 and a reference point PM on the mandrel 120. During operation, the housing 102 rotates with rotation R1 so that its reference point PH moves relative to the borehole reference point PB. In controlling the direction of the apparatus, the mandrel 120 is rotated with a second rotation R2 (shown here as a counter rotation) so that the mandrel's reference point PM is controlled, fixed stationary, etc. relative to the borehole's point PB.

As the steering apparatus 50 rotates, the orientation of the directional devices 150*a-c* is determined by the control system (200), position sensors, toolface (TF), etc. When it is desired to deviate the drill bit in a direction towards the direction given by arrow D, it is necessary to extend one or more of the directional devices 150*a-c* as they face the opposite direction O.

For example, to deviate the borehole in the chosen direction D, the control system (200) calculates the orientation of the diametrically opposed position O and can orient the second rotation R2 of the mandrel 120 so that the directional devices 150*a-c* operate to extend toward the opposed position O and retract toward the chosen direction D as they rotate with the housing 102. Specifically, the control system (200) may orient the mandrel 120 so that one directional device 150*a* extends at a first angular orientation a in FIG. 8A relative to the desired direction D and then retracts at a second angular orientation 13 in FIG. 8B for the rotation of the steering apparatus 50. As will be appreciated, the toolface (TF) of the housing 102 can be determined by the control system (200) using the sensors and techniques discussed previously.

Because the directional device 150*a* is rotating in direction R1 with the housing 102, orientation of the directional device 150*a* relative to a reference point is determined using the toolface (TF) of the housing 102. This thereby corresponds to the directional device 150*a* being actuated to extend starting at a first angular orientation BA relative to the toolface (TF) and to retract at a second angular orientation BA relative to the toolface (TF).

Because the directional device 150*a* does not move instantaneously to its extended condition, it may be necessary that the active deflection functions before the directional device 150*a* reaches the opposite position O and that the active deflection remains active for a proportion of each rotation R1. Thus, the directional device 150*a* can be extended during a segment S of the rotation R1 best suited for the directional device 150*a* to extend and retract relative to the housing 102 and engage the borehole to deflect the housing 102. The RPM of the housing's rotation R1, the drilling direction D relative to the toolface (TF), the operating metrics of the directional device 150*a*, and other factors involved can be used to define the segment S. If desired, it can be arranged that the angles α and β are equally-spaced to either side of the position O, but because it is likely that the directional device 150*a* will extend gradually (and in particular more slowly than it will retract) it may be preferable that the angle β is closer to the position O than is the angle α.

Of course, the steering apparatus 50 as disclosed herein has the additional directional devices 150*b-c* arranged at different angular orientations about the housing's circumference. Extension and retraction of these additional directional devices 150*b-c* can be comparably controlled in conjunction with what has been discussed with reference to FIGS. 8A-8B so that the control system (200) can coordinate multiple retractions and extensions of several directional devices 150*b-c* during each of (or one or more of) the rotations R1. Thus, the displacement of the housing 102 and directional devices 150*b-c* can be timed with the rotation R1 of the drillstring (22) and the apparatus 50 based on the orientation of the steering apparatus 50 in the advancing borehole. The displacement can ultimately be timed to direct the drill bit (40) in a desired drilling direction D and can be performed with each rotation or any subset of the rotations.

Figure 9A:
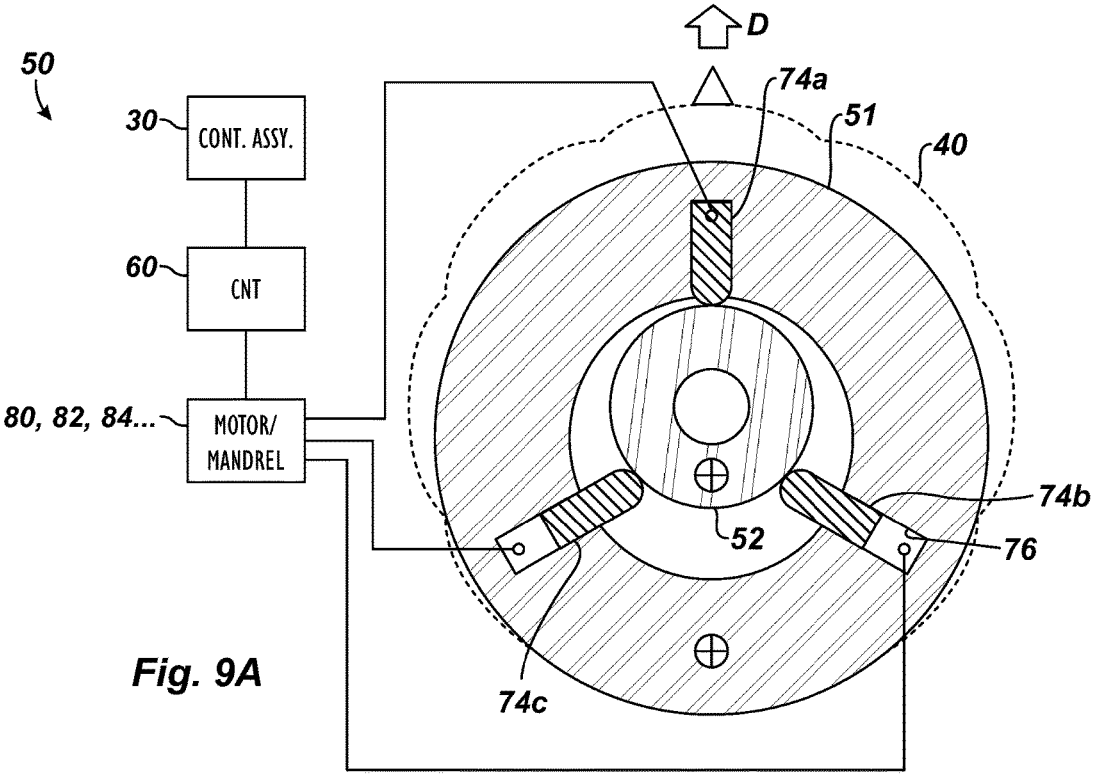
FIGS. 9A-9B schematically illustrate the disclosed system having a point-the-bit steering configuration.
Figure 9B:
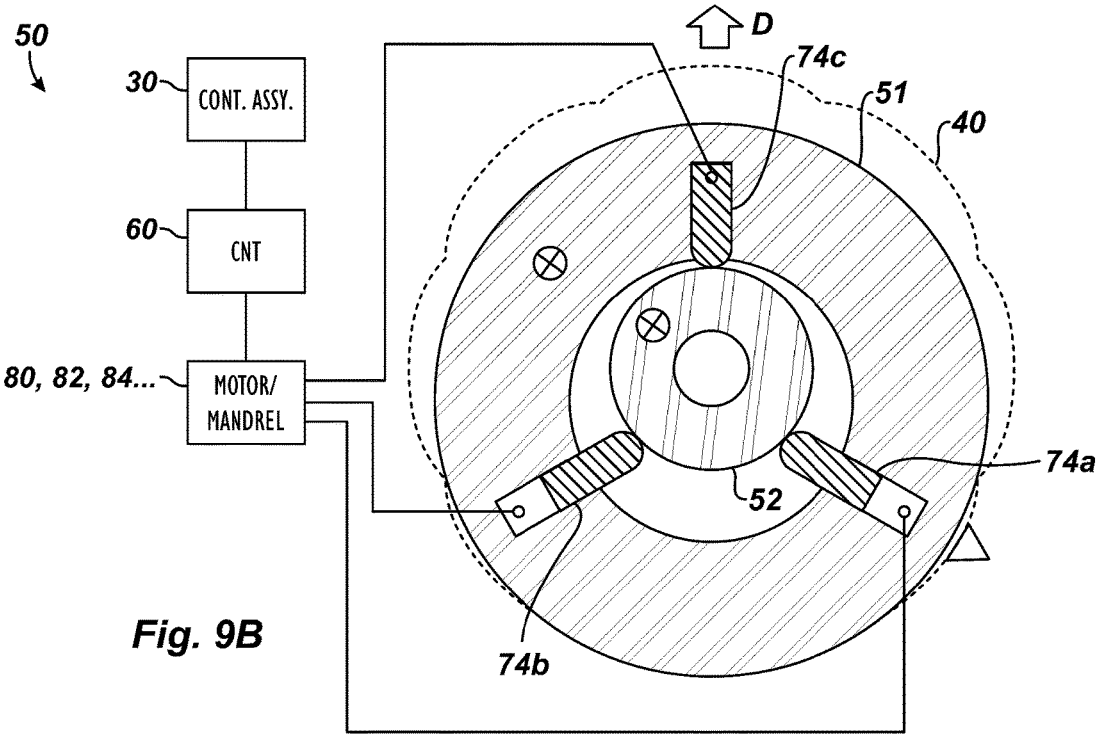

As noted above, comparable components and techniques disclosed herein can be used in the point-the-bit steering configuration of the disclosed system 50. FIG. 6A provided a brief example of this. Looking at some more details, FIGS. 9A-9B schematically illustrate the disclosed system 50 having the point-the-bit steering configuration. Again, in this point-the-bit configuration, the drilling direction of the bit 40 in a desired direction D is changed by pushing the internal shaft 52 of the system 50 having the drill bit 40 in the desired direction. As such, the components and techniques disclosed herein with respect to the push-the-bit system (e.g., actuators, valves, pistons, etc.) can apply equally well to a point-the-bit system. In fact, as shown in FIGS. 9A-9B, the system 50 involves a reversal of the pushing components from an external (push) to an internal (point) arrangement and involves a reversal of the directing of pushing from external to internal.

In particular, FIGS. 9A-9B show a number of pistons 74*a-c* disposed in piston chambers 76 of the system's housing 51. The internal shaft 52 connected to the drill bit 40 is positioned in the housing 52, and the various pistons 74*a-c* are movable against the shaft 52 to change the pointing of the bit 40. The internal shaft 52 can be a jointed shaft, a flexible shaft, or the like having the drill bit 40 connected to it so that pushing against the shaft 103 in one direction can either move the drill bit 40 in the same direction or an opposite direction. As noted herein, the entire system 50 rotates, meaning that the housing 51, pistons 74*a-c*, shaft 52, etc. all rotate in the borehole. The control assembly 30, controller 60, motor 80, mandrel 82, valve 84/eccentricity 86, and the like actuate the various pistons 74*a-c* to point the shaft 52 and connected bit 40 in a desired direction in the borehole in a manner similar to the functioning discussed in previous configurations.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the disclosed subject matter. Therefore, it is intended that the disclosed subject matter include all modifications and alterations to the full extent that they come within the scope of the disclosed embodiments or the equivalents thereof.

What is claimed is:

1. A drilling assembly disposed on a drillstring for deviating a borehole advanced by a drill bit, the assembly comprising:

a housing disposed on the drillstring and at least partially rotating with first rotation transferred to the drill bit;

one or more directors disposed on the housing to rotate therewith, each of the one or more directors being independently movable between an extended condition and a retracted condition relative to the housing;

an actuator disposed on the assembly and being operable provide a second rotation relative to the first rotation; and an internal component disposed in the housing and being rotatable by the second rotation of the actuator to have first and second conditions relative to each of the one or more directors rotating with the first rotation of the housing, the internal component comprising a mandrel having an eccentricity relative to the second rotation, the eccentricity in the first condition engaging a given one of the one or more directors to extend toward the extended condition, the eccentricity in the second condition disengaging a given one of the one or more directors to allow retraction of flail the given one of the one or more directors toward the retracted condition.

2. The assembly of claim 1, wherein the housing comprises a drillstring subcomponent having one end connected toward the drillstring and having an opposing end connected toward the drill bit, the drillstring subcomponent transferring the first rotation from the one end to the drill bit toward the opposite end.

3. The assembly of claim 1, wherein the housing comprises a sleeve rotatably disposed on a drillstring subcomponent, the drillstring subcomponent having one end connected toward the drillstring and having an opposing end connected toward the drill bit, the drillstring subcomponent transferring the first rotation from the one end to the drill bit toward the opposite end.

4. The assembly of claim 1, further comprising a controller disposed on the assembly and controlling operation of the actuator.

5. The assembly of claim 4, wherein the controller comprises:

an angular rate gyroscope measuring an angular rate of the housing as the housing rotates;

a magnetometer measuring orientation of the housing as the housing rotates relative to the borehole; and control circuitry taking a desired trajectory for the borehole and translating the desired trajectory into independent actuations of the actuators based on the angular rate and the orientation of the housing.

6. The assembly of claim 1, wherein the actuator comprises an electric motor.

7. The assembly of claim 6, further comprising a power source disposed on the assembly and supplying electrical power to the electric motor.

8. The assembly of claim 7, wherein the power source comprises one or more of a battery, and a turbine generator powered by the communicated fluid.

9. The assembly of claim 1, wherein the actuator comprises a mud motor powered by the communicated fluid.

10. The assembly of claim 1, wherein each of the one or more directors comprises a biasing element biasing the each director toward the retracted condition.

11. The assembly of claim 1, wherein the mandrel comprises a bearing rotatably supporting the mandrel inside the housing.

12. A drilling assembly disposed on a drillstring for deviating a borehole advanced by a drill bit, the assembly comprising:

a housing disposed on the drillstring and at least partially rotating with first rotation transferred to the drill bit;

one or more directors disposed on the housing to rotate therewith, each of the one or more directors being independently movable between an extended condition and a retracted condition relative to the housing;

an actuator disposed on the assembly and being operable provide a second rotation relative to the first rotation;

an internal component disposed in the housing and being rotatable by the second rotation of the actuator to have first and second conditions relative to each of the one or more directors rotating with the first rotation of the housing, the internal component in the first condition extending a given one of the one or more directors toward the extended condition, the internal component in the second condition allowing retraction of a given one of the one or more directors toward the retracted condition; and a controller disposed to rotate with the housing, the controller determining angular orientations of each of the one or more directors relative to a desired trajectory for the borehole and translating the determined orientations to the second rotation of the actuator relative to the first rotation of the housing to deviate the borehole toward the desired trajectory.

13. The assembly of claim 12, wherein the internal component comprises a valve disposed in fluid communication between communicated fluid in the housing and the borehole, the valve being actuated by the second rotation of the actuator to have the first and second conditions relative to the one or more directors rotating with the first rotation of the housing, the valve in the first condition directing the communicated fluid to extend the given director toward the extended condition, the valve in the second condition allowing venting of the communicated fluid to the borehole to retract the given director toward the retracted condition.

14. The assembly of claim 13, wherein each of the one or more directors comprises a piston movable in a chamber of the housing, the chamber being in fluid communication with the valve to receive and vent the communicated fluid.

15. The assembly of claim 14, wherein the one or more directors are disposed symmetrically about a circumference of the housing.

16. The assembly of claim 13, wherein the valve comprises a flow inlet for the communicated fluid, at least a portion of the communicated fluid in the flow inlet being directed to the given director when the valve is in the first condition relative thereto.

17. The assembly of claim 16, wherein the valve comprises a flow outlet in communication outside the housing and venting the communicated fluid from the given director when the valve is in the second condition relative thereto.

18. The assembly of claim 13, wherein the valve is in the first condition relative to one of the one or more directors while the valve is in the second condition relative to one or more other of the one or more directors.

19. The assembly of claim 12, wherein the internal component comprises a mandrel having an eccentricity relative to the second rotation, the eccentricity in the first condition engaging the given director to extend toward the extended condition, the eccentricity in the second condition disengaging the given director to retract toward the retracted condition.

20. The assembly of claim 12, wherein the controller comprises:

an angular rate gyroscope measuring an angular rate of the housing as the housing rotates;

a magnetometer measuring orientation of the housing as the housing rotates relative to the borehole; and control circuitry operatively coupled to the angular rate gyroscope and the magnetometer and using the angular rate and the orientation of the housing in the determination and translation to deviate the borehole toward the desired trajectory.

21. The assembly of claim 12, wherein the housing comprises:

a drillstring subcomponent having one end connected toward the drillstring and having an opposing end connected toward the drill bit, the drillstring subcomponent transferring the first rotation from the one end to the drill bit toward the opposite end; or a sleeve rotatably disposed on a drillstring subcomponent, the drillstring subcomponent having one end connected toward the drillstring and having an opposing end connected toward the drill bit, the drillstring subcomponent transferring the first rotation from the one end to the drill bit toward the opposite end.

22. The assembly of claim 12, wherein the actuator comprises an electric motor and the assembly comprises a power source disposed on the assembly and supplying electrical power to the electric motor; or wherein the actuator comprises a mud motor powered by the communicated fluid.

23. The assembly of claim 12, wherein each of the one or more directors comprises a biasing element biasing the each director toward the retracted condition.

* * * * *